United States Patent [19]

Fujimura et al.

[11] Patent Number: 4,600,672

[45] Date of Patent: Jul. 15, 1986

[54] ELECTROPHOTOGRAPHIC ELEMENT HAVING AN AMORPHOUS SILICON PHOTOCONDUCTOR

[75] Inventors: Itaru Fujimura, Numazu; Yukio Ide, Mishima; Yoshiyuki Kageyama, Numazu; Masako Kunita, Fuji, all of Japan

[73] Assignee: Ricoh Co., Ltd., Tokyo, Japan

[21] Appl. No.: 684,566

[22] Filed: Dec. 21, 1984

[30] Foreign Application Priority Data

Dec. 28, 1983 [JP] Japan ..... 58-250200

[51] Int. Cl.[4] ..... G03G 5/085

[52] U.S. Cl. ..... 430/64; 430/84; 430/95

[58] Field of Search ..... 430/57, 64, 67, 84, 430/85, 95

[56] References Cited

U.S. PATENT DOCUMENTS

| | | | |
|---|---|---|---|
| 4,377,628 | 3/1983 | Ishioka et al. | 430/64 |
| 4,452,874 | 6/1984 | Ogawa et al. | 430/57 |
| 4,465,750 | 8/1984 | Ogawa et al. | 430/57 |
| 4,483,911 | 11/1984 | Ogawa et al. | 430/65 |
| 4,490,450 | 12/1984 | Shimizu et al. | 430/84 |
| 4,490,453 | 12/1984 | Shirai et al. | 430/57 |

*Primary Examiner*—John L. Goodrow

*Attorney, Agent, or Firm*—Flynn, Thiel, Boutell & Tanis

[57] ABSTRACT

An electrophotographic element which comprises forming, on an electrically conductive substrate, an intermediate layer designed to function so that carriers homopolar with those injected from said substrate at the time of charging may become majority carrier, and forming, on said intermediate layer, a photoconductive layer.

7 Claims, 2 Drawing Figures

ELECTROPHOTOGRAPHIC ELEMENT HAVING AN AMORPHOUS SILICON PHOTOCONDUCTOR

BACKGROUND OF THE INVENTION

1. Field of the Invention

The present invention relates to an electrophotographic element, in particular relates to an electrophotographic element which comprises providing an intermediate layer having a specified function on an electrically conductive substrate and providing a photosensitive layer (photoconductive layer) on said intermediate layer. In the electrophotographic element according to the present invention, carriers are recombined on the interface between the photoconductive layer and the intermediate layer, whereby residual electric potential is reduced remarkably.

2. Description of the Prior Art

As the representative examples of photoconductive materials used in the electrophotographic element there have usually been enumerated inorganic materials such as Se, ZnO, CdS and the like and organic materials such as poly-N-vinylcarbazole (PVK), trinitrofluorenone (TNF) and the like. Recently, however, amorphous silicon (which is sometimes called "a-Si" hereinafter) has come to attract public attention. The reason is considered to consist in that the use of the electrophotographic element employing a-Si as the photoconductive layer (photosensitive layer) brings about constantly stable electrophotographic characteristics and therefore high quality images can always be obtained.

However, the fact is that conventional a-Si electrophotographic elements hold the following defects substantially in common: (1) Said elements are insufficient in chargeability due to severe dark decay, (2) Said elements cause blurred images and white-spot portions in images while being used actually in copying machines (or printing machines), (3) Said elements are susceptible to contaminants on the substrate surfaces and consequently abnormal images are caused, (4) Said elements are insufficient in high temperature resistance and high humidity resistance, and the like. This tendency can be observed also in conventional inorganic or organic electrophotographic elements, apart from great and small degrees, and therefore more improvement is demanded therefor.

SUMMARY OF THE INVENTION

The present invention provides an electrophotographic element (inclusive of a-Si system electrophotographic element) which aims at solving the defects as aforesaid and in particular aims at preventing the occurrence of preceding (2) and (3).

In order to attain the above objects, various investigations have been carried out to ascertain that recombination of carriers should be done not on the interface against the substrate but on another newly provided interface so as to diminish the influence of the contaminated electrically conductive substrate surface. It was also ascertained that such a measure is effective for improving the gradient and eliminating the occurrence of white spots and white stripes. The present invention has been completed based on such findings.

The electrophotographic element according to the present invention comprises laminating an intermediate layer and a photoconductive layer (photosensitive layer) on an electrically conductive substrate in the order named, wherein said intermediate layer is designed to function so that carriers homopolar with carriers injected from said substrate at the time of charging may become majority carrier.

DETAILED DESCRIPTION OF THE PREFERRED EMBODIMENT OF THE INVENTION

Figure 1:
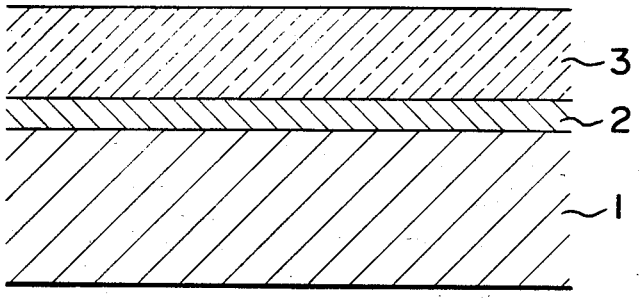
FIG. 1 is a view illustrating an electrophotographic element which comprises laminating an intermediate layer 2 and a photosensitive layer (photoconductive layer) 3 on a substrate (electrically conductive layer) 1.
Figure 2:
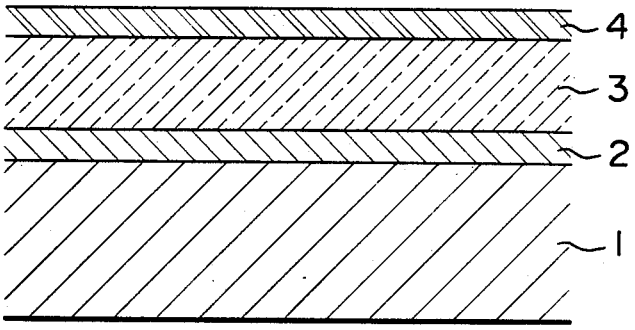
FIG. 2 is a view illustrating an electrophotographic element which comprises laminating a protective layer 4 further on said photosensitive layer 3. Said protective layer 4 is provided as occasion demands. The electrophotographic element provided with said protective layer (the one illustrated in FIG. 2) is one embodiment of the present invention.

The intermediate layer 2 of electrophotographic element according to the present invention, as mentioned above, is designed to function so that carriers homopolar with carriers injected from the substrate 1 at the time of charging may become majority carrier. Due to this, in the case of the electrophotographic element for use in a positively charged process, the intermediate layer 2 must be n-type and the photosensitive layer 3 must be i-type or p-type. In the case of the electrophotographic element for use in a negatively charged process, whilst, the intermediate layer 2 must be p-type, and the photosensitive layer 3 must be i-type or n-type. To sum up, the photosensitive layer 3 is of reversed polarity or intrinsic qualities against the intermediate layer 2.

Now, explanation will be made about the electrophotographic element according to the present invention on the supposition that said element is used under a positively charged process. Carriers injected from the substrate 1 at the time of charging are electrons. In this instance, a n-type layer where electrons become majority carrier is employed as the intermediate layer 2, and a p-type layer where holes of reversed polarity become majority carrier is employed as the photosensitive layer 3. Accordingly, at the time of light radiation following said charging, holes travelling on the photosensitive layer 3 towards the substrate 1 come to recombine with electrons injected from the substrate 1 on the interface between p-n layers (namely, the interface between the photosensitive layer 3 and the intermediate layer 2).

As the electrically conductive substrate 1 there is applicable any one used commonly in this field such, for instance, as Al, stainless or the like. In addition, resinous films or sheets, papers, glass and the like, whose surfaces have been subjected to conductive treatment, can be used effectively as the substrate 1. The examples of "conductive treatment" as aforesaid include lamination and vapordeposition with metals, impregnation with conductive agents and the like. The substrate 1 may take configurations such as cylinder-shaped, belt-shaped, plate-shaped and the like according to the desired shape.

The intermediate layer 2 may be formed of organic materials such as resin and the like or inorganic materials such as silicon oxide, magnesium fluoride and the like, but it is desirable that the intermediate layer 2 should be formed of amorphous materials consisting essentially of silicon, at least one member of nitrogen, oxygen and carbon, and at least one member of hydrogen, and fluorine.

When the intermediate layer 2 is formed of the organic material, it is necessary that an acceptor and/or a donor should be added in the organic material. In case the intermediate layer is made p-type an acceptor alone should be contained therein, or when both the donor and the acceptor are contained therein the concentration of the acceptor should be increased. On the other hand, in case the intermediate layer is made n-type a donor alone should be contained therein, or when both the donor and the acceptor are contained therein the concentration of the donor should be increased.

As the acceptor and donor referred to herein there can be used hitherto well known ones. As the acceptor there can be enumerated for instance quinone; nitro compound, nitrile, acid anhydride, alkylhalide and the like. As the donor, whilst, there can be enumerated for instance olefin, aromatic compound, amine and the like.

The intermediate layer of the type wherein a charge transfer agent has been added to the organic material (polyester resin, urethane resin, phenol resin, polyethylene resin, fluoric resin or the like) is formed so as to have a thickness of about 0.1–about 5.0 μm, preferably about 0.2–about 2.0 μm by means of dipping method, blading method or the like.

In case the intermediate layer 2 is formed of the inorganic material, vapor-depositing method, sputtering method or the like is employed, and the intermediate layer is formed so as to have a thickness of about 0.1–about 5 μm, preferably about 0.2–about 2.0 μm.

As mentioned previously, it is desirable that the intermediate layer should be formed of an amorphous material consisting essentially of silicon, at least one member selected from nitrogen, oxygen and carbon, and at least one member selected from hydrogen and fluorine. In this amorphous material layer (intermediate layer 2), a-Si is predominant.

In case the intermediate layer 2 is formed of the amorphous material as mentioned above, the a-Si may be added further with elements coming under Group IIIA of the Periodic Table (B, Al, Ga, In, Tl and the like) or elements coming under Group VA of the Periodic Table (P, As, Sb and the like) in case of necessity.

The intermediate layer may be formed by means of known methods such as glow discharge method, sputtering method, ion plating method, electron beam method, ion implantation method and the like. Taking various points into consideration, however, glow discharge method and sputtering method are profitable.

When glow discharge method is employed, a raw gas may be mixed with a diluting gas in a proper ratio as occasion demands, and this mixture may be introduced in a vacuum sedimentation room equipped with the substrate 1 and turned into plasma.

As the raw gas there are used Si; N, O and/or C; H and/or F, and further the one obtained by gasifying a gaseous substance or a gasifiable substance having at least one member of elements coming under Group IIIA of the Periodic Table (or elements coming under Group VA of the Periodic Table) as a constituent atom. The raw gas may be the one obtained by mixing the respective raw gases having their respective components as constituent atoms in a desired mixing ratio, or the one obtained by mixing the raw gas having two or more components as constituent atoms with the raw gas having one component as a constituent atom.

As the starting materials which can become the above mentioned raw gases there may be enumerated for instance $SiH_4$, $Si_2H_6$ and the like having Si and H as constituent atoms, and $B_2H_6$ and the like having H and B as constituent atoms $H_2$ and $N_2$ are also useful.

When sputtering method is employed, it suffices to use a single crystal or polycrystal Si wafer or a Si-containing wafer as a target and subject it to sputtering in a proper gas atmosphere. As the gas referred to herein there can be effectively used the raw gases enumerated previously concerning the glow discharge method.

As the diluting gases used in these methods there can be enumerated He, Ne, Ar, $H_2$ and the like.

In view of the fact that the intermediate layer 2 according to the present invention must possess the specified function (namely, the function of making the carriers homopolar with those injected from the substrate at the time of charging the majority carrier), the forming operation of said layer 2 must be carried out so that it may be endowed with the function like that. Depending or whether the intermediate layer 2 formed of the amorphous material is p-type or n-type, the amounts of elements to be doped in the a-Si (N, O and/or C; H and/or F; if necessary, elements coming under Group IIIA of the Periodic Table and elements coming under Group VA of the Periodic Table) change, which can be deduced experiments.

That is, according to our inventors' findings obtained from experiments, the amount of N, O or C contained in the a-Si is in the range of 0.5–30 atomic preferably in the range of 5–20 atomic % respectively, %, and the amount of H or F contained in the a-Si is in the range of 5–40 atomic %, preferably in the range of 10–35 atomic % respectively. In case elements coming under Group IIIA of the Periodic Table or elements coming under Group VA of the Periodic Table as occasion demands, the amounts of these elements doped suitably are in the range of 50–1000 ppm. In practice, the aforesaid 50–1000 ppm of the elements coming under Group IIIA of the Periodic Table donates the gas mixing ratio in terms of $B_2H_6$ because a large amount of B is employed in the elements coming under Group IIIA of the Periodic Table. Likewise, the aforesaid 50–1000 ppm of the elements coming under Group VA of the Periodic Table denotes the gas mixing ratio in terms of $PH_3$ because a large amount of P is employed in the elements coming under Group VA of the Periodic Table.

The thickness of the intermediate layer (a-Si system intermediate layer) in this instance suitably is in the range of 100 Å–5 μm, preferably in the range of 500 Å–1 μm. In case said intermediate layer is thinner than 100 Å, carriers generated from the photosensitive layer pass through the intermediate layer onto the substrate making use of the so-called tunnel effect, whereby recombination is effected on the substrate surface. In case said intermediate layer is thicker than 5 μm, carriers injected from the substrate are difficult to reach the interface between the intermediate layer and the photosensitive layer with effect.

As mentioned above, the photosensitive layer 3 is n-type or i-type in case the intermediate layer 2 is p-type, and is p-type or i-type in case the intermediate layer 2 is n-type. Accordingly, the inorganic conductive materials such as Se, Se-As and Se-Tl (every one is p-type). CdS (Cu dope; n-type), ZnO (n-type) and the like can themselves be used in the photosensitive layer.

In case the intermediate layer 2 is formed of the aforesaid amorphous material, it is desirable that the photosensitive layer 3 should be an a-Si system. The a-Si system photosensitive layer is formed by doping H and/or F in the a-Si, and further doping at least one member selected from N, O and C as occasion demands. The a-Si system photosensitive layer is classified into p-type, i-type and n-type based on differences in combinations and amounts added of these elements. This is applicable to the intermediate layer formed of aforesaid amorphous material. It is profitable for making the a-Si photosensitive layer p-type to add elements coming under Group IIIA of the Periodic Table to said a-Si system photosensitive layer in proper amounts. Taking for instance the case of B, it suffices to add $B_2H_6$ in an amount of about 100–1000 ppm in terms of the gas mixing ratio. In order to make said a-Si system photosensitive layer n-type, although somewhat n-type without adding impurities particularly in the cases of a-Si:H, a-Si:N:H, and a-Si:C:N:H, it is preferable to add the element coming under Group VA of the Periodic Table in a proper amount. Taking for instance the case of P, it suffices to add $PH_3$ in an amount of about 10–1000 ppm in terms of the gas mixing ratio. In order to make said a-Si system photosensitive layer i-type, furthermore, in the cases of a-Si:N:H, and a-Si:C:N:H, it suffices to add $B_2H_6$ in an amount of about 10–100 ppm in terms of the gas mixing ratio. In this connection, it is to be noted that in the case of a-Si:C:H, the a-Si system photosensitive layer itself is substantially i-type without adding other impurities.

The thickness of the photosensitive layer is 5–100 μm, preferably 10–40 μm. When the photosensitive layer is thinner than 5 μm, a sufficient surface electric potential can not be obtained as well as radiated light reaches the intermediate layer to generate excess light carriers, whereby the electrophotographic element is susceptible to a bad influence from the substrate interface. When the photosensitive layer is thicker than 100 μm, contrarily, it brings about undesirable results that the photosensitive layer becomes easy to peel off and the cost of the electrophotographic element is increased.

The a-Si system photosensitive layer 3 can be formed according to the same procedure as employed in the formation of the amorphous intermediate layer 2.

In the case of the electrophotographic element according to the present invention, as stated previously, it is requisite that the photosensitive layer 3 and the intermediate layer 2 should be in a specified relationship. Accordingly, there is the necessity of selecting the materials constituting the photosensitive layer and the intermediate layer and the like so as to satisfy said specified relationship.

The protective layer 4 is formed on the photosensitive layer 3 as occasion demands, and its thickness is about 0.05–about 5.0 μm, preferably about 0.1–about 2.0 μm. The materials used suitably in forming the protective layer 4 include silicon nitride, silicon carbide, silicon oxide, boron nitride, boron nitride carbide and the like.

The electrophotographic element according to the present invention includes both the one normally used in the copying machine and the printing drum of the printing machine to which electrophotography has been applied.

As can be seen from aforegoing, the electrophotographic element according to the present invention is the one designed to employ the layer wherein carriers homopolar with those injected from the substrate at the time of charging become majority carrier as the intermediate layer (the layer provided between the substrate and the photosensitive layer). It is also common to provide the intermediate layer of the electrophotographic element by laminating the intermediate layer and the photoconductive layer on the electrically conductive substrate in the order named with a function of hindering the flow of carriers from the substrate side into the photoconductive layer and permitting the passage of carriers, generated in the photoconductive layer due to light radiation and transferring towards the substrate side, from the photoconductive layer side to the substrate side. However, the electrophotographic element like this can not achieve the object of the present invention because it exhibits vicious tendencies to increase residual electric potential and be susceptible to the influence from some contaminants present on the substrate surface to thereby bring about abnormal images.

The present invention possesses the following advantages such as (a) and (b):

(a) In the electrophotographic element according to the present invention, recombination of carriers is carried out on the interface between the intermediate layer and the photosensitive layer (photoconductive layer), whereby the residual electric potential is markedly little or substantially none and the bad influence of some contaminants present on the substrate surface upon images is exceedingly difficult to appear. This fact means that clear-cut images can be obtained and further this face produces degrees of freedom in the surface cleanness (cleaning method, indoor cleanness and the like) at the time of manufacturing the electrophotographic element, handling and the like, whereby a great deal of advantages are brought about in the points of cost and operations. (b) Due to the presence of the intermediate layer, the film growth of the photosensitive layer at the time of manufacturing the electrophotographic element is unified in the surface and film directions, whereby abnormal points (for instance, crystallized portion) decrease remarkably and consequently the occurrence of abnormal images is inhibited.

EXAMPLE

An intermediate layer and a photoconductive layer were formed on a 80ϕ×340 mm aluminum drum (substrate) in the order named by the use of a coaxial cylindrical glow discharge apparatus and under the condition of using the gases shown in Table-1. Thus, six kinds of electrophotographic elements according to the present invention were prepared.

These preparing operations were carried out under the conditions: substrate temperature 230° C., discharge frequency 13.56 MHz, discharge electric power 0.24 W/cm$^3$ and reaction pressure 0.8 torr, and the film thickness of the intermediate layer was adjusted to be about 4000 Å and the film thickness of the photosensitive layer (photoconductive layer) was adjusted to be about 18 μm.

TABLE 1

| Element No. | Intermediate layer Gas used [flow rate (SCCM)] | | Photosensitive layer Gas used [flow rate (SCCM)] | |
|---|---|---|---|---|
| 1 | $SiH_4$(20%)/$H_2$ | [500] | $SiH_4$(20%)/$H_2$ | [500] |
| | $N_2$ | [100] | $N_2$ | [20] |
| | | | $B_2H_6$(1000 ppm)/$H_2$ | [10] |
| 2 | $SiH_4$(20%)$H_2$ | [500] | $SiH_4$(20%)/$H_2$ | [500] |
| | $B_2H_6$(1000 ppm)/$H_2$ | [10] | $PH_3$(100 ppm)/$H_2$ | [10] |
| | $N_2$ | [100] | $CH_4$ | [10] |

TABLE 1-continued

| Element No. | Intermediate layer Gas used [flow rate (SCCM)] | | Photosensitive layer Gas used [flow rate (SCCM)] | |
|---|---|---|---|---|
| | $O_2$(1%)/$H_2$ | [100] | $N_2$ | [20] |
| | | | $O_2$ | [5] |
| 3 | $SiH_4$(20%)/$H_2$ | [500] | $SiH_4$(20%)/$H_2$ | [500] |
| | $N_2$ | [100] | $N_2$ | [20] |
| | $O_2$(1%)/$H_2$ | [100] | $O_2$(1%)/$H_2$ | [100] |
| | | | $B_2H_6$(1000 ppm)/$H_2$ | [10] |
| 4 | $SiH_4$(20%)/$H_2$ | [500] | $SiH_4$(20%)/$H_2$ | [500] |
| | $CH_4$ | [70] | $CH_4$ | [30] |
| | | | $B_2H_6$(1000 ppm)/$H_2$ | [10] |
| 5 | $SiH_4$(20%)/$H_2$ | [500] | $SiH_4$(20%)/$H_2$ | [500] |
| | $N_2$ | [100] | $N_2$ | [20] |
| | | | $CH_4$ | [10] |
| | | | $B_2H_6$(1000 ppm) | [10] |
| 6 | $SiH_4$(20%)/$H_2$ | [500] | $SiH_4$(20%)/$H_2$ | [500] |
| | $N_2$ | [100] | $N_2$ | [20] |
| | $B_2H_6$(1000 ppm)/$H_2$ | [20] | $CH_4$ | [10] |
| | | | $PH_3$(100 ppm)/$H_2$ | [10] |

(i) Electrophotographic element No. 1 was set in a dry copying machine [the remodelled machine (+6.5 KV corona charge) of RECOPY-FT4060] and subjected to continuous image production of 100000 sheets to find that clearcut images entirely free from abnormal images with white spots and white stripes and superior in gradient were obtained. For reference, said element No. 1 was set in a copying machine wherein the charging process was changed to be −6.5 KV and subjected to image production to find that abnormal images with much white spots and white stripes considered to have been caused by the influence of some contaminants present on the substrate surface.

This tendency was observed likewise with reference to Electrophotographic elements No. 3, No. 4 and No. 5 for use in positive charge similar to Electrophotographic element No. 1.

For comparison, a comparative electrophotographic element was prepared according to the same procedure as employed in the preparation of Electrophotographic element No. 1 except that the intermediate layer was not provided and subjected to image production under the same conditions as mentioned above (+6.5 KV corona charge) to find that the extraordinally occurrence of white spots and white stripes as compared with Example of the present invention was observed.

(ii) Further, Electrophotographic element No. 2 was subjected to image production according to the same conditions as employed in Electrophotographic element No. 1 to find that a plenty of clear-cut images were obtained in the process charged −6.5 KV, but abnormal images were obtained in the process charged +6.5 KV.

This tendency was observed likewise with reference to Electrophotographic element No. 6 for use in negative charge similar to Electrophotographic element No. 2.

We claim:

1. An electrophotographic element consisting essentially of an electrically conductive substrate, an intermediate layer on said substrate and in face-to-face contact therewith, and a photosensitive layer on said intermediate layer and in face-to-face contact therewith, said intermediate layer having a thickness in the range of from 500 Angstrom units to 1 micrometer and said photosensitive layer having a thickness in the range of from 10 to 40 micrometers, said intermediate layer and said photosensitive layer being made of compositions consisting essentially of amorphous silicon containing from 0.5 to 30 atomic % at least one member selected from the first group consisting of nitrogen, oxygen and carbon and from 5 to 40 atomic % of at least one member selected from the second group consisting of hydrogen and fluorine, said photosensitive layer and said intermediate layer having different compositions so that said intermediate layer exhibits either (a) p-type semiconduction or (b) n-type semiconduction, and said photosensitive layer exhibits either (1) intrinsic conduction, or (2) the other of (a) or (b), whereby the majority of the charge carriers that become present in the intermediate layer are of the same polarity as the charge carriers that are injected from said substrate into said intermediate layer at the time that said photosensitive layer is uniformly charged during the electrophotography process and, when the charged electrophotographic element is imagewise exposed, the charge on the surface of said photosensitive layer is neutralized in the exposed areas by combination of the charge carriers of opposite polarity at the interface between said intermediate layer and said photosensitive layer.

2. An electrophotographic element as claimed in claim 1 in which said intermediate layer is made of a material that exhibits n-type semiconduction and said photosensitive layer is made of a material that exhibits intrinsic conduction or p-type semiconduction.

3. An electrophotographic element as claimed in claim 1 in which said intermediate layer is made of a material that exhibits p-type semiconduction and said photosensitive layer is made of a material that exhibits intrinsic conduction or n-type semiconduction.

4. An electrophotographic element as claimed in claim 1 in which the amount of said member of said first group is from 5 to 20 atomic % and the amount of said member of said second group is from 10 to 35 atomic %.

5. An electrophotographic element as claimed in claim 1 in which at least one of said compositions is doped with from 50 to 1000 ppm of at least one element of Group IIIA and Group VA of the Periodic Table.

6. An electrophotography process in which an electrophotographic element as claimed in claim 2 is charged positively and then is imagewise exposed and developed.

7. An electrophotography process in which an electrophotographic element as claimed in claim 3 in charged negatively and then is imagewise exposed and developed.

* * * * *